US012560363B2

(12) United States Patent
Raimbault

(10) Patent No.: US 12,560,363 B2
(45) Date of Patent: Feb. 24, 2026

(54) HEAT PUMP HAVING A CHARGE MANAGEMENT RECEIVER

(71) Applicant: TRANE INTERNATIONAL INC., Davidson, NC (US)

(72) Inventor: Yves Jacques Raimbault, Uxegney (FR)

(73) Assignee: TRANE INTERNATIONAL INC., Davidson, NC (US)

( * ) Notice: Subject to any disclaimer, the term of this patent is extended or adjusted under 35 U.S.C. 154(b) by 196 days.

(21) Appl. No.: 18/304,828

(22) Filed: Apr. 21, 2023

(65) Prior Publication Data

US 2024/0353159 A1 Oct. 24, 2024

(51) Int. Cl.

| | |
|---|---|
| ***F25B 45/00*** | (2006.01) |
| ***F25B 30/02*** | (2006.01) |
| ***F25B 41/20*** | (2021.01) |
| ***F25B 49/02*** | (2006.01) |

(52) U.S. Cl.

CPC ..... *F25B 45/00* (2013.01); *F25B 30/02* (2013.01); *F25B 41/20* (2021.01); *F25B 49/02* (2013.01); *F25B 2600/05* (2013.01)

(58) Field of Classification Search

CPC ..... F25B 45/00; F25B 30/02; F25B 41/20; F25B 49/02; F25B 2600/05; F25B 2400/00; F25B 2400/0415; F25B 2400/19; F25B 9/06; F25B 2400/075; F25B 2400/16; F25B 2600/2523; F25B 43/006; F25B 13/00

See application file for complete search history.

(56) References Cited

U.S. PATENT DOCUMENTS

| | | | |
|---|---|---|---|
| 4,537,045 | A | 8/1985 | Mayer |
| 5,233,842 | A | 8/1993 | Manning et al. |
| 5,479,790 | A | 1/1996 | Bottum, Jr. et al. |
| 5,927,102 | A | 7/1999 | Matsuo et al. |
| 6,463,757 | B1 | 10/2002 | Dickson et al. |

(Continued)

FOREIGN PATENT DOCUMENTS

| | | | |
|---|---|---|---|
| CN | 109737623 | A | 5/2019 |
| CN | 118999016 | A * | 11/2024 |

(Continued)

OTHER PUBLICATIONS

Extended European Search Report, European Patent Application No. 24171083.9, Oct. 24, 2024 (10 pages).

*Primary Examiner* — Kun Kai Ma
(74) *Attorney, Agent, or Firm* — HSML P.C.

(57) ABSTRACT

A receiver assembly for a heat pump system is provided including a first receiver volume and a second receiver volume. The first receiver volume is configured to accommodate an amount of refrigerant based on a difference between a refrigerant charge for cooling operations of the heat pump system and a refrigerant charge for heating operations of the heat pump system. The second receiver volume has a first fluid connection configured to receive a hot gas injection and a second fluid connection. An expander is disposed along the second fluid connection. The receiver assembly further includes a fluid line configured to connect the first receiver volume and the second receiver volume and a controllable valve configured to regulate flow between the first receiver volume and the second receiver volume disposed along the fluid line.

19 Claims, 4 Drawing Sheets

(56) References Cited

U.S. PATENT DOCUMENTS

| | | | | |
|---|---|---|---|---|
| 6,681,597 | B1 | 1/2004 | Yin et al. | |
| 8,397,522 | B2 | 3/2013 | Springer et al. | |
| 9,057,548 | B2 | 6/2015 | Liu | |
| 9,989,289 | B2 | 6/2018 | Zolli et al. | |
| 10,247,456 | B2 | 4/2019 | Gov et al. | |
| 2003/0024266 | A1 | 2/2003 | Zhang et al. | |
| 2006/0213215 | A1* | 9/2006 | Hirano | F25B 47/022 62/340 |

FOREIGN PATENT DOCUMENTS

| | | | | | |
|---|---|---|---|---|---|
| EP | 4071424 | A1 | | 10/2022 | |
| JP | 2006284034 | A | * | 10/2006 | |
| KR | 2009126548 | A | * | 12/2009 | F25B 43/006 |
| KR | 20140018524 | A | | 2/2014 | |
| WO | WO-2011070917 | A1 | * | 6/2011 | F25B 45/00 |
| WO | WO-2015059945 | A1 | * | 4/2015 | F24F 11/30 |

* cited by examiner

HEAT PUMP HAVING A CHARGE MANAGEMENT RECEIVER

FIELD

This disclosure is directed to heating, ventilation, air conditioning, and refrigeration (HVACR) systems including multiple receiver volumes for storing refrigerant and controlling refrigerant charge during operation.

BACKGROUND

Reversible heat pumps can have differing requirements regarding the refrigerant charge between operation in a cooling mode and operation in a heating mode. Additionally, ambient conditions can affect the refrigerant density within the system and change system performance and charge requirements. Systems having a fixed receiver to store the difference in charge between heating and cooling modes can experience a buildup of liquid refrigerant in a condenser due to ambient conditions, reducing the effective condensing area.

SUMMARY

This disclosure is directed to heating, ventilation, air conditioning, and refrigeration (HVACR) systems including multiple receiver volumes for storing refrigerant and controlling refrigerant charge during operation.

By providing a variable receiver along with the fixed storage receiver, changes due to ambient conditions can be accounted for and charge can be properly controlled even when the fixed storage receiver is used to contain refrigerant based on the operating mode of the reversible heat pump. The separate fixed and variable storage receivers can each respectively store the refrigerant in a preferred phase, for example one storing liquid refrigerant at subcooled temperature and another full of gas refrigerant at evaporating temperature. This can facilitate operation of the heat pump by allowing the sourcing of appropriate refrigerant based on the operation of the heat pump and the adjustment being made to the refrigerant charge. Further, the fixed and variable storage receivers can be combined into one receiver structure, thus saving space and simplifying installation of such HVACR systems. Additionally, the respective volumes of the variable and fixed storage portions can be selected to provide improved transfer of refrigerant into and out of the variable and fixed storage portions. This receiver arrangement can further improve safety by preventing situations where the volume of working fluid to be stored exceeds capacity of the receivers. Additionally, the receivers allow the working fluid charge of the heat pump system to substantially cover a full operating map for the compressor.

In an embodiment, a receiver assembly for a heat pump system includes a first receiver volume and a second receiver volume. The second receiver volume has a first fluid connection configured to receive a hot gas injection and a second fluid connection, wherein an expander is disposed along the second fluid connection. The receiver assembly further includes a fluid line configured to connect the first receiver volume and the second receiver volume and a controllable valve disposed along the fluid line, the controllable valve configured to regulate flow between the first receiver volume and the second receiver volume. The first receiver volume is configured to accommodate an amount of refrigerant based on a difference between a refrigerant charge for cooling operations of the heat pump system and a refrigerant charge for heating operations of the heat pump system.

In an embodiment, the receiver assembly includes a housing configured to at least partially define each of the first receiver volume and the second receiver volume, and a divider disposed within the housing, the divider separating the first receiver volume from the second receiver volume.

In an embodiment, the second receiver volume has a volume that is from 25% to 35% of a volume of the first receiver volume.

In an embodiment, the first receiver volume is located vertically above the second receiver volume.

In an embodiment, the second fluid connection includes a first outlet check valve configured to allow flow from the expander to a first heat exchanger and obstruct flow from the first heat exchanger to the expander, and a second outlet check valve configured to allow flow from the expander to a second heat exchanger and obstruct flow from the second heat exchanger to the expander.

In an embodiment, the receiver assembly further includes a third fluid connection, the third fluid connection connected to the first receiver volume, the third fluid connection including a first inlet check valve configured to allow flow from a first heat exchanger to the first receiver volume and obstruct flow from the first receiver volume to the first heat exchanger, and a second inlet check valve configured to allow flow from a second heat exchanger to the first receiver volume and obstruct flow from the first receiver volume to the second heat exchanger.

In an embodiment, the receiver assembly further includes a controller configured to control the controllable valve.

In an embodiment, a heat pump system includes a compressor, a flow reverser, a first heat exchanger and a second heat exchanger. The heat pump system further includes a receiver assembly, the receiver assembly including a first receiver volume, a second receiver volume, a fluid line configured to connect the first receiver volume and the second receiver volume, and a controllable valve disposed along the fluid line, the controllable valve configured to regulate flow between the first receiver volume and the second receiver volume. The first receiver volume is configured to accommodate an amount of refrigerant based on a difference between a refrigerant charge for cooling operations of the heat pump system and a refrigerant charge for heating operations of the heat pump system. The heat pump system further includes a hot gas injection line providing fluid communication between the compressor and the second receiver volume.

In an embodiment, the receiver assembly is connected to the first heat exchanger and the second heat exchanger by a first fluid connection, the second fluid connection including a first outlet check valve configured to allow flow from the expander to a first heat exchanger and obstruct flow from the first heat exchanger to the expander, and a second outlet check valve configured to allow flow from the expander to a second heat exchanger and obstruct flow from the second heat exchanger to the expander.

In an embodiment, the receiver assembly is connected to the first heat exchanger and the second heat exchanger by a second fluid connection, the second fluid connection including a first inlet check valve configured to allow flow from a first heat exchanger to the first receiver volume and obstruct flow from the first receiver volume to the first heat exchanger, and a second inlet check valve configured to allow flow from a second heat exchanger to the first receiver volume and obstruct flow from the first receiver volume to the second heat exchanger.

In an embodiment, the heat pump system further includes a controller configured to control the controllable valve. In an embodiment, the controller is configured to control the controllable valve based on a condensing pressure of the heat pump system. In an embodiment, the controller is configured to control the controllable valve based on a discharge temperature of the heat pump system. In an embodiment, the controller is configured to control the controllable valve based on an in-volute pressure differential of the compressor. In an embodiment, the controller is configured to control the controllable valve so as to allow flow from the second receiver volume to the first receiver volume when fluid is provided by way of the hot gas injection.

In an embodiment, a method for operating a heat pump system includes operating the heat pump system in a cooling mode having a first working fluid charge level, operating the heat pump system in a heating mode having a second working fluid charge level, wherein when the heat pump is in the heating mode, storing working fluid that is the difference between the first working fluid charge level and the second working fluid charge level in a first receiver volume, and controlling a variable quantity of refrigerant stored in a second receiver volume based on one or more operational parameters of the heat pump system. The first receiver volume and the second receiver volume are connected by a fluid line including a controllable valve.

In an embodiment, the one or more operational parameters include at least one of a condensing pressure of the heat pump system, a discharge temperature of the heat pump system, or an in-volute pressure differential of a compressor of the heat pump system.

In an embodiment, the method further includes providing an injection of gas from a compressor of the heat pump system to the second receiver volume.

In an embodiment, the difference between the first working fluid charge level and the second working fluid charge level is determined for an ambient temperature of 7° C.

DRAWING

DETAILED DESCRIPTION

This disclosure is directed to heating, ventilation, air conditioning, and refrigeration (HVACR) systems including multiple receiver volumes for storing refrigerant and controlling refrigerant charge during operation.

Figure 1A:
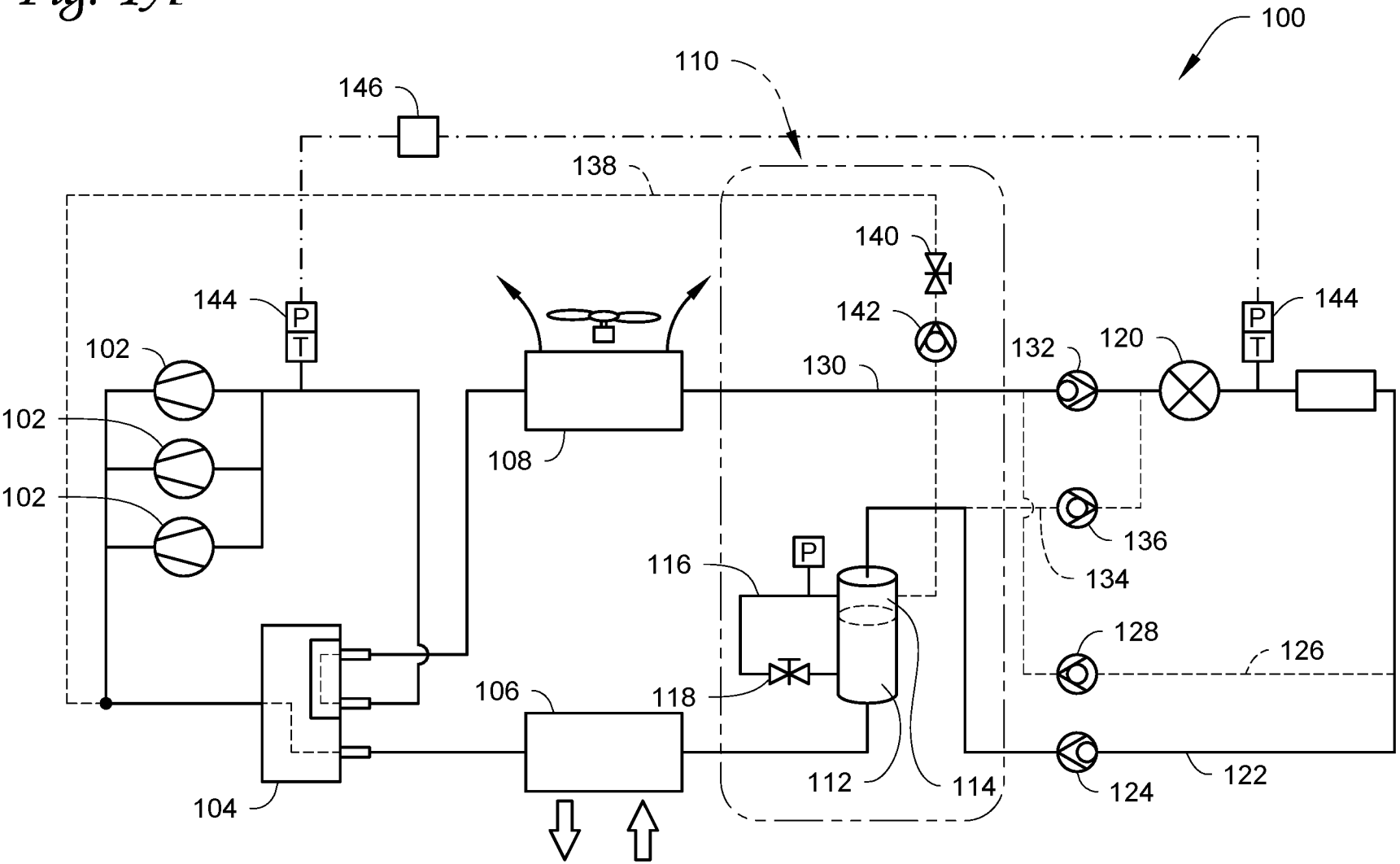
FIG. 1A shows a schematic of a heat pump system according to an embodiment in a heating mode.

FIG. 1A shows a schematic of a heat pump system according to an embodiment in a heating mode. Heat pump system 100 includes one or more compressor(s) 102, flow reverser 104, first heat exchanger 106, second heat exchanger 108, and receiver assembly 110. Receiver assembly 110 includes a first receiver volume 112 and a second receiver volume 114. Receiver assembly 110 can be connected to heat pump system 100 by way of suitable piping and valves, for example, fluid line 116 including a controllable valve 118, an expander 120, a first inlet line 122 having a first inlet check valve 124, a second inlet line 126 having a second inlet check valve 128, a first outlet line 130 having a first outlet check valve 132, and a second outlet line 134 having a second outlet check valve 136 in the embodiment shown in FIG. 1. In an embodiment, the piping and valves can be included in the receiver assembly 110. The heat pump system 100 further includes a hot gas injection line 138 including a control valve 140 and a check valve 142. Optionally sensors 144 can be included in heat pump system 100 and/or receiver assembly 110.

Heat pump system 100 is a reversible heat pump configured to provide heating to a conditioned space when operated in a heating mode and cooling to the conditioned space when operated in a cooling mode. Heat pump system 100 contains a charge of working fluid. The charge of working fluid that is circulating during operation of the heat pump system 100 can be adjusted using the receiver assembly 110 provided in the heat pump system 100. The working fluid can be any suitable working fluid for such a system.

Heat pump system includes one or more compressor(s) 102 configured to compress the working fluid. In an embodiment, the heat pump system 100 includes a plurality of compressors 102 provided in parallel with one another. In an embodiment, the heat pump system 100 includes a single compressor 102. The compressor(s) 102 can be any suitable type of compressor for compressing the working fluid.

Discharge from the compressor(s) 102 passes to flow reverser 104. Flow reverser 104 is configured to selectively direct flow from the discharge from the compressor(s) 102 to one of first heat exchanger 106 or second heat exchanger 108, and to direct the flow from the other of the first heat exchanger 106 or second heat exchanger 108 to a suction of the compressor(s) 102. The flow reverser 104 is configured such that it can be controlled to direct the flow from the discharge of the compressor(s) 102 to the first heat exchanger 106 when the heat pump system 100 is in a heating mode, and to direct the flow from the discharge of the compressor(s) 102 to the second heat exchanger 108 when the heat pump system 100 is in a cooling mode.

First heat exchanger 106 is a heat exchanger configured to exchange heat so as to heat or cool the conditioned space. The first heat exchanger 106 can exchange heat with the conditioned space directly or by way of exchanging heat with a process fluid that is circulated to provide the heating or cooling to the conditioned space. In the heating mode, first heat exchanger 106 can receive hot working fluid discharged from the one or more compressor(s) 102 to provide heating to the conditioned space. In the cooling mode, first heat exchanger 106 can receive cool expanded working fluid from the receiver assembly 110 that has rejected heat at second heat exchanger 108 and passed through expander 120. The cool expanded working fluid at first heat exchanger 106 can absorb heat, providing cooling to the conditioned space.

Second heat exchanger 108 is a heat exchanger configured to exchange heat with an ambient environment. In the cooling mode, second heat exchanger can receive hot working fluid discharged from the one or more compressor(s) 102 to allow the working fluid to reject heat to the ambient environment. In the cooling mode, first heat exchanger 106 can receive cool expanded working fluid from the receiver assembly 110 that has rejected heat at second heat exchanger 108 and passed through expander 120. The cool expanded working fluid can absorb heat from the ambient environment at second heat exchanger 108.

Receiver assembly 110 is configured to store a portion of the working fluid charge of heat pump system 100 such that an amount of working fluid being circulated by the heat pump system 100 is suitable for the operating mode and operational conditions of the heat pump system 100. The working fluid passes through receiver assembly 110 when passing from first heat exchanger 106 to second heat exchanger 108 when operating in the heating mode or from second heat exchanger 108 to first heat exchanger 106 when operating in the cooling mode.

Receiver assembly 110 includes first receiver volume 112. First receiver volume 112 is a volume configured to accept and store working fluid based on a difference between the working fluid charge used when heat pump system 100 is in the cooling mode and the working fluid charge used when heat pump system 100 is in the heating mode. The first receiver volume 112 can be defined at least in part by a housing. First receiver volume 112 can be sized based on the difference between the working fluid charge used when heat pump system 100 is in the cooling mode and the working fluid charge used when heat pump system 100 is in the heating mode. The amount of working fluid can be determined for selected ambient conditions for the heat pump system 100. In an embodiment, the amount of working fluid is calculated based on an ambient temperature of at or about 7° C.

Figure 2:
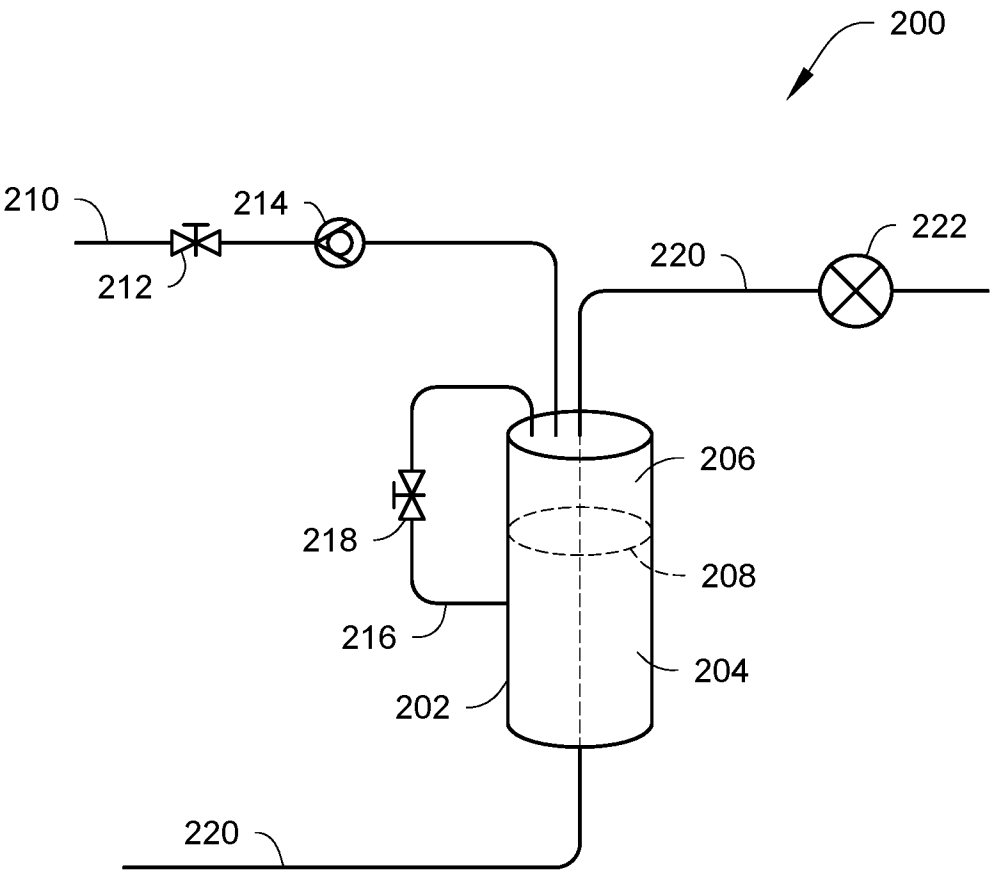
FIG. 2 shows a receiver according to an embodiment.

The receiver assembly 110 further includes a second receiver volume 114, which is separate from the first receiver volume 112. In an embodiment, the second receiver volume 114 and the first receiver volume 112 can be included in a common housing, separated by a divider, for example as shown in FIG. 2 and discussed below. Second receiver volume 114 is configured to accommodate working fluid in a quantity such that the working fluid charge in heat pump system 100 can be adapted to particular operating conditions within an operating mode of the heat pump system 100. For example, second receiver volume 114 can be configured to accept working fluid such that during operation in the heating mode or the cooling mode, the amount of working fluid being circulated through heat pump system 100 is adjusted to account for operating conditions of the heat pump system 100. The amount of working fluid stored in the second receiver volume can be controlled so as to achieve target values or be within target ranges for one or more operational parameters. The operational parameters can include, for example, a condensing pressure of the heat pump system 100, a discharge temperature of the heat pump system 100, and/or an in-volute pressure differential of a compressor of the heat pump system 100.

In an embodiment, the volume of second receiver volume 114 can be determined by testing of required refrigerant charges over an operating map of the heat pump system 100. Second receiver volume 114 can have a volume that is equal to or smaller than the volume of the first receiver volume 112. In an embodiment, the second receiver volume 114 has a volume that is approximately 25 to 35% of the volume of the first receiver volume 112. In an embodiment, the second receiver volume 114 can be sized to facilitate transfer of working fluid from between first receiver volume 112 and the second receiver volume 114 during operations such as switching from cooling to heating mode.

First receiver volume 112 and second receiver volume 114 are connected by the fluid line 116. Fluid line 116 includes a controllable valve 118 configured to regulate flow between the first receiver volume 112 and the second receiver volume 114. Controllable valve 118 can be controlled to adjust the amount of working fluid in first receiver volume 112 and second receiver volume 114.

Expander 120 is included in the flow path the working fluid takes through receiver assembly 110. The expander 120 is configured to expand the working fluid. Expander 120 can be any suitable expander, for example an expansion valve, an expansion plate, an expansion vessel, one or more expansion orifices, or any other known suitable structure for expanding the working fluid. In an embodiment, the expander 120 is an electronic expansion valve. In an embodiment, expander 120 is configured to be downstream of the first receiver volume 112 and the second receiver volume 114 in a heating mode of the heat pump 100, and upstream of the first receiver volume 112 and the second receiver volume 114 in a cooling mode of the heat pump 100.

Receiver assembly 110 can be connected to the first and second heat exchangers 106, 108 by way of a first inlet line 122 having a first inlet check valve 124, a second inlet line 126 having a second inlet check valve 128, a first outlet line 130 having a first outlet check valve 132, and a second outlet line 134 having a second outlet check valve 136.

The first inlet line 122 connects the first heat exchanger 106 to the receiver assembly 110. First inlet line 122 includes first inlet check valve 124, which is configured to allow flow from the first heat exchanger 106 to the receiver assembly 110, and to obstruct flow back from the receiver assembly 110 to the first heat exchanger 106. When the heat pump system 100 is in the heating mode, the first inlet check valve 124 permits flow from the first heat exchanger to the receiver assembly 110. When the heat pump system 100 is in the cooling mode, the first inlet check valve 124 is closed by the direction of flow from the receiver assembly 110.

The second inlet line 126 connects the second heat exchanger 108 to the receiver assembly 110. Second inlet line 126 includes second inlet check valve 128, which is configured to allow flow from the second heat exchanger 108 to the receiver assembly 110, and to obstruct flow back from the receiver assembly 110 to the second heat exchanger 108. When the heat pump system 100 is in the heating mode, the second inlet check valve 128 is closed by the direction of flow from the receiver assembly 110. When the heat pump system 100 is in the cooling mode, the second inlet check valve 128 permits flow from the second heat exchanger 108 into the receiver assembly 110.

The first outlet line 130 connects the receiver assembly 110 to the first heat exchanger 106. First outlet line 130 includes first outlet check valve 132, which is configured to allow flow from the receiver assembly 110 to the first heat exchanger 106, and to obstruct flow back from the first heat exchanger 106 to the receiver assembly 110. When the heat pump system 100 is in the heating mode, the first outlet check valve is closed by the direction of flow from the first heat exchanger 106. When the heat pump system 100 is in the cooling mode, the check valve 132 allows the flow from receiver assembly 110 to the first heat exchanger 106.

The second outlet line 134 connects the receiver assembly 110 to the second heat exchanger 108. First outlet line 130 includes first outlet check valve 132, which is configured to allow flow from the receiver assembly 110 to the second heat exchanger 108, and to obstruct flow back from the second heat exchanger 108 to the receiver assembly 110. When the heat pump system 100 is in the heating mode, the check valve 132 allows the flow from receiver assembly 110 to the second heat exchanger 108. When the heat pump system 100 is in the cooling mode, the first outlet check valve is closed by the direction of flow from the second heat exchanger 108.

Heat pump system can include a hot gas injection line 138. Hot gas injection line 138 is configured to convey a flow of working fluid from the discharge of the one or more compressor(s) 102 to the second receiver volume 114. The hot gas injection line 138 can be used to provide a flow of hot working fluid to drive working fluid out of the second receiver volume, so as to recover working fluid from the receiver assembly 110. The hot gas injection line 138 can include a control valve 140 and a check valve 142. Control valve 140 is configured to control a quantity of working fluid passing through hot gas injection line 138 to the second receiver volume 114. The control valve 140 can be a controllable valve such as a stepper valve having a variable orifice size or otherwise capable of controlling the amount of flow that is permitted by the control valve 140 such that a variable quantity of the working fluid can be allowed to pass through the hot gas injection line 138 to the second receiver volume 114. Check valve 142 is configured to allow the flow of working fluid from the discharge of the compressor(s) 102 to pass towards second receiver volume 114, and obstruct flow back from the second receiver volume 114 towards the discharge of the compressor(s) 102.

Optionally, sensors 144 can be provided at various points along the heat pump system 100. The sensors 144 can include pressure and/or temperature sensors. The sensors 144 can be connected to a controller 146. The controller 146 can be configured to control the heat pump system 100 or specific components thereof based on operational parameters of the heat pump system 100. The controller can be configured to determine the operational parameters based at least in part on readings from the sensors 144, the operating mode of the compressor, and/or other such inputs. In an embodiment, the operational parameters can include, for example, a condensing pressure of the heat pump system, a discharge temperature of the heat pump system, an in-volute pressure differential of one or more compressor(s) of the heat pump system, or the like.

Figure 1B:
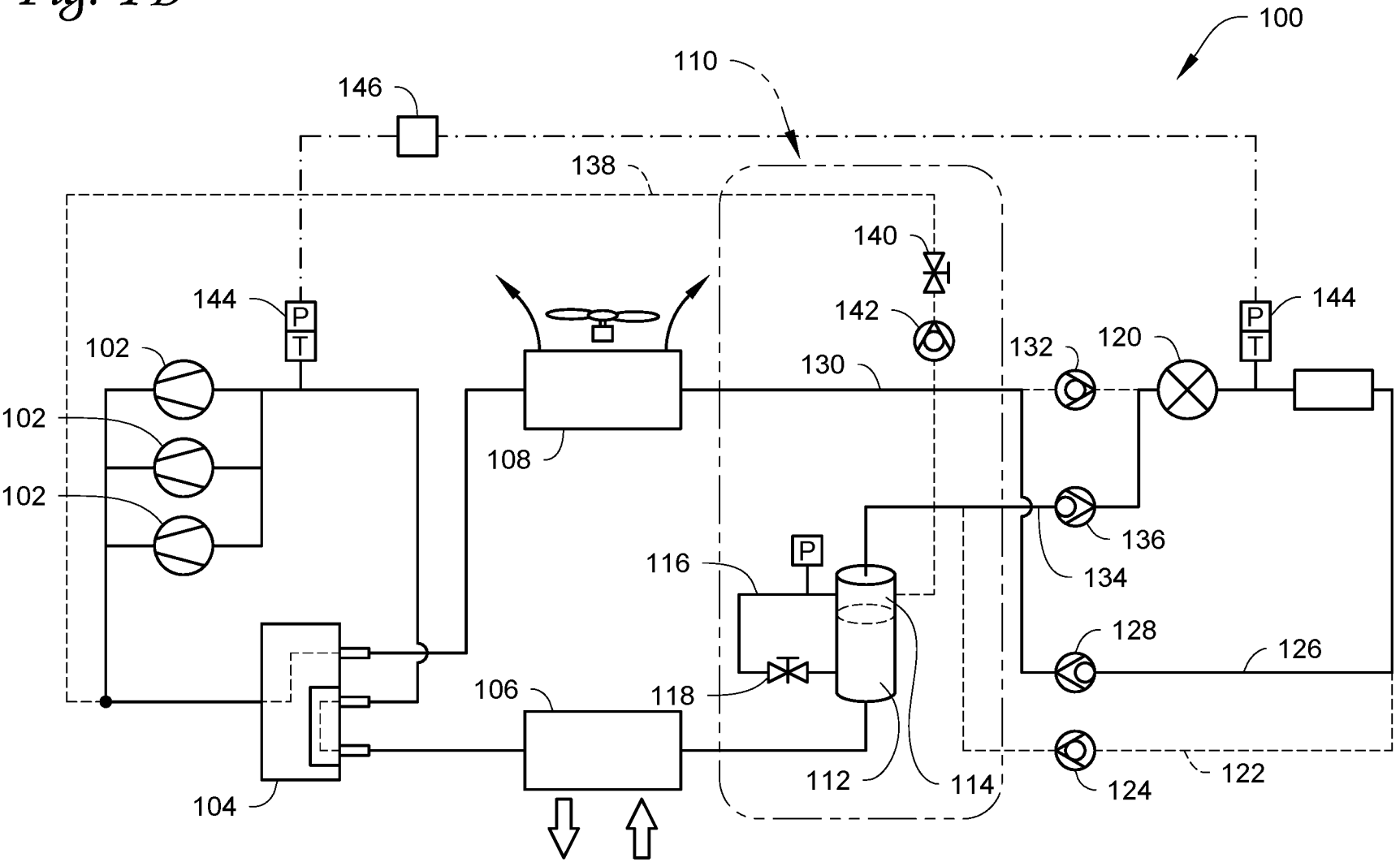
FIG. 1B shows a schematic of the heat pump system of FIG. 1A in a cooling mode.

FIG. 1B shows a schematic of the heat pump system of FIG. 1A in a cooling mode. In the cooling mode of FIG. 1B, the flow reverser 104 directs the discharge of the compressor (s) 102 to the second heat exchanger 108 to reject heat to the ambient environment. The working fluid passes from the second heat exchanger 108 through second inlet check valve 128 to the second inlet line 126, which conveys the working fluid to receiver assembly 110. The working fluid passes through the first and second receiver volumes 112, 114, and through expander 120. The working fluid leaving expander 120 passes through second outlet line 134 and through check valve 136 to first heat exchanger 106, where the working fluid provides cooling to the conditioned space, either directly or by way of a process fluid such as but not limited to water, glycol, combinations thereof, or the like, which is then used for cooling of the conditioned space. In the cooling mode shown in FIG. 1B, the first receiver volume 112 can be substantially empty, with only trace amounts of residual working fluid within the first receiver volume 112. In the cooling mode shown in FIG. 1B, a variable quantity of working fluid may be present within second receiver volume 114 based on operating parameters of the heat pump system 100.

FIG. 2 shows a receiver according to an embodiment. Receiver 200 includes housing 202. Housing 202 at least partially defines first receiver volume 204 and second receiver volume 206. A divider 208 within housing 202 separates first receiver volume 204 from second receiver volume 206. Hot gas injection line 210 is connected to the second receiver volume 206 by way of injection control valve 212 and check valve 214. Fluid line 216 connects the first receiver volume 204 to the second receiver volume 206. Controllable valve 218 is disposed along fluid line 216. Working fluid line 220 passes through housing 202.

Receiver 200 can be used in the receiver assembly 110 described above and shown in FIGS. 1A and 1B. The receiver 200 includes first receiver volume 204 and second receiver volume 206. The first and second receiver volumes 204, 206 are sealed from one another. In an embodiment, the first and second receiver volumes 204, 206 communicate with one another through fluid line 216. The housing 202 can contain both the first receiver volume 204 and the second receiver volume 206, thus including both the first receiver volume 204 and the second receiver volume 206 within a single unit. The housing 202 and the divider 208 can combine to define the first and second receiver volumes 204, 206. In an embodiment, the divider 208 can be dome-shaped. In embodiments, one or both of housing 202 and divider 208 can be formed of sheet metal. In an alternative embodiment, the first and second receiver volumes 204, 206 can be provided in separate receiver structures. In an embodiment, the relative positions of first receiver volume 204 and second receiver volume 206 within housing 202 is such that when the receiver 200 is installed into a heat pump system (e.g. 100), the second receiver volume 206 is located vertically above the first receive volume 204. In an embodiment, the second receiver volume 206 is vertically superposed over the first receiver volume 204.

First receiver volume 204 can be sized so as to be capable of accommodating an amount of working fluid based on the difference between a working fluid charge used for the cooling mode and a working fluid charge used for the heating mode. The amount of working fluid can be determined for selected ambient conditions for the heat pump system, such as intended ambient conditions for the installation where the receiver 200 is to be used. In an embodiment, the amount of working fluid is calculated based on an ambient temperature of at or about 7° C. In an embodiment, the amount of working fluid can be calculated based on regulation rating points for the heat pump system. The first receiver volume 204 can be filled with working fluid during operation of the heat pump system in the heating mode.

Second receiver volume 206 is configured to accommodate a variable quantity of working fluid to allow for the working fluid charge to be controlled to improve operational performance over the operating map of the heat pump system. The second receiver volume 206 can have a volume that is smaller than the volume of the first receiver volume 204. The second receiver volume 206 can have a volume that is approximately 25 to 35% of the volume of the first receiver volume 204. In an embodiment, the second receiver volume 206 can be sized to facilitate transfer of working fluid from between first receiver volume 204 and the second receiver volume 206 during operations such as switching from cooling to heating mode.

Fluid line 216 connects the first receiver volume 204 to the second receiver volume 206. Controllable valve 218 is disposed along fluid line 216. Fluid line 216 can be used to transfer working fluid from first receiver volume 204 to second receiver volume 206 or from second receiver volume 206 to first receiver volume 204. Controllable valve 218 can be any suitable controllable valve for regulating the amount of flow through fluid line 216. As a non-limiting example, controllable valve 218 can be a valve controlled using a stepper motor. The controllable valve 218 can be controlled based on one or more of a condensing pressure of the heat pump system, a discharge temperature of the heat pump system, or an in-volute pressure differential of a compressor of the heat pump system.

Hot gas injection line 210 connects a discharge of compressors of the heat pump system with the second receiver volume 206. The hot gas injection line 210 can include injection control valve 212 and check valve 214. Injection control valve 212 is a controllable valve configured to regulate an amount of working fluid passing through hot gas injection line 210 to the second receiver volume 206. Injection control valve 212 can be any suitable controllable valve capable of regulating the flow of working fluid. Check valve 214 can be any suitable design of check valve configured to permit flow through the hot gas injection line 210 towards the second receiver volume 206, while blocking flow in a direction from the second receiver volume 206 towards the discharge of the compressors (e.g. 102) that hot gas injection line 210 is connected to.

Working fluid line 220 passes through housing 202. Working fluid line 220 includes expander 222. Working fluid line 220 can be configured to allow working fluid to be selectively introduced into first receiver volume 204. The working fluid line 220 can be connected to the first and second heat exchangers (e.g. 106, 108). Expander 222 is disposed along working fluid line 220. The expander 222 can be any suitable expander as described herein for use in the heat pump system to expand the working fluid. The expander 222 can be, as a non-limiting example, an electronic expansion valve. The expander 222 can be positioned along working fluid 220 such that when the heat pump system is in a heating mode, the working fluid passes through the portion of working fluid line 220 that passes through housing 202 prior to the working fluid passing through expander 222. The expander 222 can be positioned along working fluid line 220 such that when the heat pump system is in the cooling mode, the working fluid passes through the expander 222 prior to passing through the portion of the working fluid line 220 that passes through the housing 202. Working fluid line 220 can be connected to the heat pump system by piping including a plurality of check valves, for example as shown in FIGS. 1A and 1B.

Figure 3:
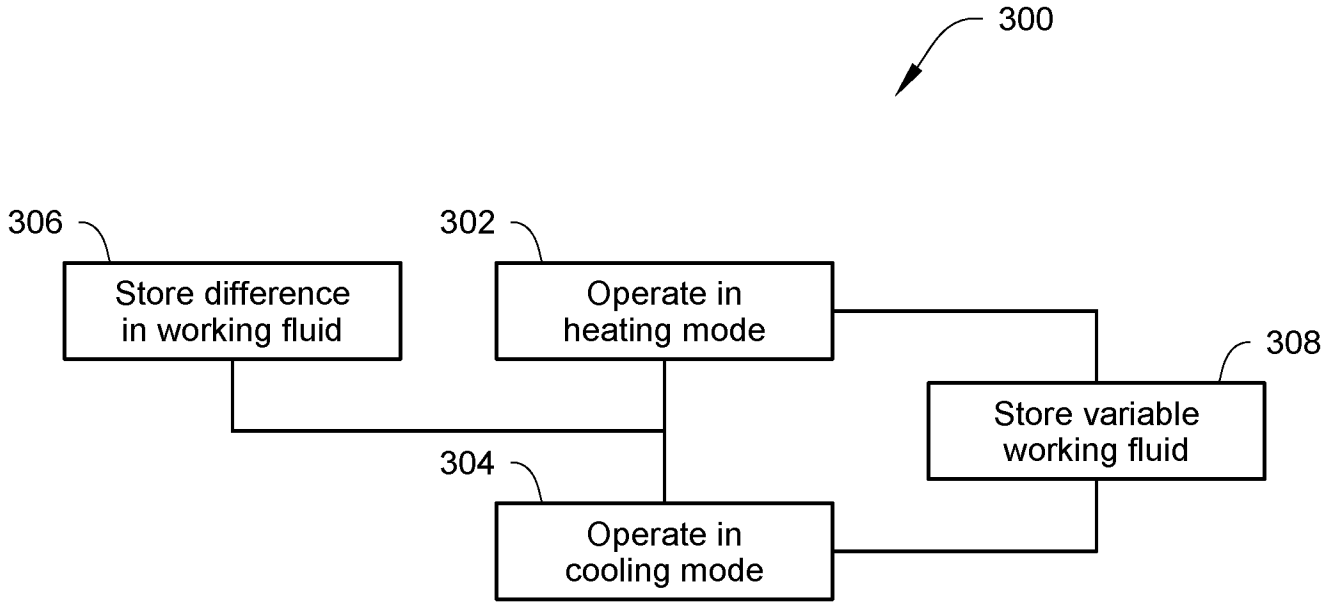
FIG. 3 shows a flowchart of a method for controlling a heat pump system including a receiver according to an embodiment.

FIG. 3 shows a flowchart of a method for controlling a heat pump system including a receiver assembly according to an embodiment. Method 300 includes operating the heat pump system in a heating mode 302, operating the heat pump system in a cooling mode 304, storing a difference in working fluid charges in a first receiver volume 306, and storing a variable volume of working fluid in a second receiver volume 308.

Operating in the heating mode at 302 can include compressing a working fluid at one or more compressors such as compressor(s) 102 as discussed above and shown in FIG. 1, directing, using a flow reverser such as flow reverser 104, the compressed working fluid to a first heat exchanger such as first heat exchanger 106 to provide heat to a conditioned space. Operating in the heating mode 302 can further include directing the working fluid through the receiver assembly (e.g. 110, receiver 200), directing the working fluid to a second heat exchanger such as second heat exchanger 108 to exchange heat with the ambient environment, and returning the working fluid to the one or more compressors. In an embodiment, the heat pump system (e.g. 100) is configured such that the working fluid at the receiver assembly passes through an expander prior to passing through the receiver(s) of the receiver assembly when operating in heating mode 302. The operation in the heating mode at 302 is performed using a charge of the working fluid having a first quantity of working fluid.

Operating in the cooling mode at 304 can include compressing a working fluid at one or more compressors such as compressor(s) 102 as discussed above and shown in FIG. 1, directing, using a flow reverser such as flow reverser 104, the compressed working fluid to a first heat exchanger such as second heat exchanger 108 to reject heat to an ambient environment. Operating in the heating mode 302 can further include directing the working fluid through the receiver assembly, directing the working fluid to a second heat exchanger such as first heat exchanger 108 to cool the conditioned space, and returning the working fluid to the one or more compressors. In an embodiment, the heat pump system is configured such that the working fluid at the receiver assembly passes through the receiver(s) of the receiver assembly prior to passing through an expander when operating in cooling mode 304. The operation in the cooling mode at 304 is performed using a charge of the working fluid having a second quantity of working fluid. In an embodiment, the second quantity of working fluid is greater than the first quantity of working fluid.

The difference in working fluid charges is stored in the first receiver volume at 306. The difference in working fluid charges is the difference between the second quantity of working fluid and the first quantity of working fluid. The storage of the difference in working fluid charges can be performed at a time that overlaps with operating in the heating mode at 302. When changing to operation in the heating mode 302 or in preparation for such operation, working fluid can be added to the first receiver volume to store excess working fluid greater than the first quantity of working fluid in the first receiver volume. The first receiver volume can be sized to accommodate the difference between the second quantity of working fluid and the first quantity of working fluid. The amount of working fluid that the first receiver volume is sized to accommodate can be determined for specific conditions, such as an ambient temperature of 7° C. Working fluid stored in the first receiver volume at 306 can be returned to circulation in the heat pump system in preparation for or when changing to operation in the cooling mode at 304. When operating in the cooling mode at 304, the first receiver volume can be substantially empty, aside from some residual working fluid. In an embodiment, flushing of the first receiver volume to end the storage of the working fluid in the first receiver volume at 306 can be delayed based on a defrosting operation of the heat pump system.

A variable volume of working fluid is stored in the second receiver volume at 308. The variable volume of working fluid can be stored in the second receiver volume to adjust the refrigerant charge based on operational parameters of the heat pump system, for example a condensing pressure of the heat pump system, a discharge temperature of the heat pump system, an in-volute pressure differential of one or more compressor(s) of the heat pump system, or the like. The storage of the variable volume at 308 can occur during either of the heating mode at 302, cooling mode at 304, and/or transitions between such modes. Storage of working fluid in the second receiver volume at 308 can include directing working fluid from the first receiver volume into the second receiver volume using a fluid line such as fluid line 216 described above and shown in FIG. 2, with a controllable valve 218 being controlled to allow the flow into the second receiver volume. In an embodiment, controlling the variable volume of working fluid stored in the second receiver volume at 308 can include providing a hot gas injection to the second receiver volume, so as to drive working fluid out of the second receiver volume. The hot gas injection can be delivered by a hot gas injection line receiving discharge from the compressor(s) of the heat pump system and conveying this discharge gas to the second receiver volume. The hot gas injection can be regulated by a controllable valve such that the hot gas injection is provided only when the variable volume being stored in the second receiver volume is to be reduced.

ASPECTS

It is understood that any of aspects 1-7 can be combined with any of aspects 8-15 or 16-19. It is understood that any of aspects 8-15 can be combined with any of aspects 16-19.

Aspect 1. A receiver assembly for a heat pump system, comprising:

a first receiver volume;

a second receiver volume, the second receiver volume having a first fluid connection configured to receive a hot gas injection and a second fluid connection, wherein an expander is disposed along the second fluid connection;

a fluid line configured to connect the first receiver volume and the second receiver volume; and a controllable valve disposed along the fluid line, the controllable valve configured to regulate flow between the first receiver volume and the second receiver volume;

wherein the first receiver volume is configured to accommodate an amount of refrigerant based on a difference between a refrigerant charge for cooling operations of the heat pump system and a refrigerant charge for heating operations of the heat pump system.

Aspect 2. The receiver assembly according to aspect 1, comprising a housing configured to at least partially define each of the first receiver volume and the second receiver volume, and a divider disposed within the housing, the divider separating the first receiver volume from the second receiver volume.

Aspect 3. The receiver assembly according to any of aspects 1-2, wherein the second receiver volume has a volume that is from 25% to 35% of a volume of the first receiver volume.

Aspect 4. The receiver assembly according to any of aspects 1-3, wherein the first receiver volume is located vertically above the second receiver volume.

Aspect 5. The receiver assembly according to any of aspects 1-4, wherein the second fluid connection includes a first outlet check valve configured to allow flow from the expander to a first heat exchanger and obstruct flow from the first heat exchanger to the expander, and a second outlet check valve configured to allow flow from the expander to a second heat exchanger and obstruct flow from the second heat exchanger to the expander.

Aspect 6. The receiver assembly according to any of aspects 1-5, further comprising a third fluid connection, the third fluid connection connected to the first receiver volume, the third fluid connection including a first inlet check valve configured to allow flow from a first heat exchanger to the first receiver volume and obstruct flow from the first receiver volume to the first heat exchanger, and a second inlet check valve configured to allow flow from a second heat exchanger to the first receiver volume and obstruct flow from the first receiver volume to the second heat exchanger.

Aspect 7. The receiver assembly according to any of aspects 1-6, further comprising a controller configured to control the controllable valve.

Aspect 8. A heat pump system, comprising:

a compressor;

a flow reverser;

a first heat exchanger;

a second heat exchanger;

a receiver assembly, the receiver assembly including:

a first receiver volume;

a second receiver volume;

a fluid line configured to connect the first receiver volume and the second receiver volume; and a controllable valve disposed along the fluid line, the controllable valve configured to regulate flow between the first receiver volume and the second receiver volume;

wherein the first receiver volume is configured to accommodate an amount of refrigerant based on a difference between a refrigerant charge for cooling operations of the heat pump system and a refrigerant charge for heating operations of the heat pump system; and a hot gas injection line providing fluid communication between the one or more compressors and the second receiver volume.

Aspect 9. The heat pump system according to aspect 8, wherein the receiver assembly is connected to the first heat exchanger and the second heat exchanger by a first fluid connection, the first fluid connection including a first outlet check valve configured to allow flow from the expander to a first heat exchanger and obstruct flow from the first heat exchanger to the expander, and a second outlet check valve configured to allow flow from the expander to a second heat exchanger and obstruct flow from the second heat exchanger to the expander.

Aspect 10. The heat pump system according to any of aspects 8-9, wherein the receiver assembly is connected to the first heat exchanger and the second heat exchanger by a second fluid connection, the second fluid connection including a first inlet check valve configured to allow flow from a first heat exchanger to the first receiver volume and obstruct flow from the first receiver volume to the first heat exchanger, and a second inlet check valve configured to allow flow from a second heat exchanger to the first receiver volume and obstruct flow from the first receiver volume to the second heat exchanger.

Aspect 11. The heat pump system according to any of aspects 8-10, further comprising a controller configured to control the controllable valve.

Aspect 12. The heat pump system according to aspect 11, wherein the controller is configured to control the controllable valve based on a condensing pressure of the heat pump system.

Aspect 13. The heat pump system according to any of aspects 11-12, wherein the controller is configured to control the controllable valve based on a discharge temperature of the heat pump system.

Aspect 14. The heat pump system according to any of aspects 11-13, wherein the controller is configured to control the controllable valve based on an in-volute pressure differential of the compressor.

Aspect 15. The heat pump system according to any of aspects 11-14, wherein the controller is configured to control the controllable valve so as to allow flow from the second receiver volume to the first receiver volume when fluid is provided by way of the hot gas injection line.

Aspect 16. A method for operating a heat pump system, comprising:

operating the heat pump system in a cooling mode having a first working fluid charge level;

operating the heat pump system in a heating mode having a second working fluid charge level, wherein when the heat pump is in the heating mode, storing working fluid that is the difference between the first working fluid charge level and the second working fluid charge level in a first receiver volume; and controlling a variable quantity of refrigerant stored in a second receiver volume based on one or more operational parameters of the heat pump system;

wherein the first receiver volume and the second receiver volume are connected by a fluid line including a controllable valve.

Aspect 16. The method according to aspect 16, wherein the one or more operational parameters include at least one of:

a condensing pressure of the heat pump system;

a discharge temperature of the heat pump system; or an in-volute pressure differential of a compressor of the heat pump system.

Aspect 18. The method according to any of aspects 16-17, further comprising providing an injection of gas from a compressor of the heat pump system to the second receiver volume.

Aspect 19. The method according to any of aspects 16-18, wherein the difference between the first working fluid charge level and the second working fluid charge level is determined for an ambient temperature of 7° C.

The examples disclosed in this application are to be considered in all respects as illustrative and not limitative. The scope of the invention is indicated by the appended claims rather than by the foregoing description; and all changes which come within the meaning and range of equivalency of the claims are intended to be embraced therein.

The invention claimed is:

1. A receiver assembly for a heat pump system, comprising:

a first receiver volume;

a second receiver volume, the second receiver volume having a first fluid connection configured to receive a hot gas injection and a second fluid connection, wherein an expander is disposed along the second fluid connection, and the first receiver volume, the second receiver volume, and the expander in series configured to connect a first heat exchanger to a second heat exchanger, the second fluid connection configured to connect the second receiver volume to the second heat exchanger via the expander;

a fluid line configured to connect the first receiver volume and the second receiver volume; and a controllable valve disposed along the fluid line, the controllable valve configured to regulate flow between the first receiver volume and the second receiver volume, wherein the first receiver volume is configured to accommodate an amount of refrigerant based on a difference between a refrigerant charge for cooling operations of the heat pump system and a refrigerant charge for heating operations of the heat pump system.

2. The receiver assembly of claim 1, comprising a housing configured to at least partially define each of the first receiver volume and the second receiver volume, and a divider disposed within the housing, the divider separating the first receiver volume from the second receiver volume.

3. The receiver assembly of claim 1, wherein the second receiver volume has a volume that is between 25% and 35% of a volume of the first receiver volume.

4. The receiver assembly of claim 1, wherein the second receiver volume is located vertically above the first receiver volume.

5. The receiver assembly of claim 1, wherein the second fluid connection includes a first outlet check valve configured to allow flow from the expander to the first heat exchanger and obstruct flow from the first heat exchanger to the expander, and a second outlet check valve configured to allow flow from the expander to the second heat exchanger and obstruct flow from the second heat exchanger to the expander.

6. The receiver assembly of claim 1, further comprising a third fluid connection, the third fluid connection connected to the first receiver volume, the third fluid connection including a first inlet check valve configured to allow flow from the first heat exchanger to the first receiver volume and obstruct flow from the first receiver volume to the first heat exchanger, and a second inlet check valve configured to allow flow from the second heat exchanger to the first receiver volume and obstruct flow from the second receiver volume to the second heat exchanger.

7. The receiver assembly of claim 1, further comprising a controller configured to control the controllable valve.

8. A heat pump system, comprising:

a compressor;

a flow reverser;

a first heat exchanger;

a second heat exchanger;

a receiver assembly, the receiver assembly including:

a first receiver volume, a second receiver volume, a fluid line configured to connect the first receiver volume and the second receiver volume, and a controllable valve disposed along the fluid line, the controllable valve configured to regulate flow between the first receiver volume and the second receiver volume, wherein the first receiver volume is configured to accommodate an amount of refrigerant based on a difference between a refrigerant charge for cooling operations of the heat pump system and a refrigerant charge for heating operations of the heat pump system;

an expander connecting the second receiver volume of the receiver assembly to the second heat exchanger, and the first receiver volume, the second receiver volume, and the expander in series connecting the first heat exchanger to the second heat exchanger; and a hot gas injection line providing fluid communication between the compressor and the second receiver volume.

9. The heat pump system of claim 8, wherein the receiver assembly is connected to the first heat exchanger and the second heat exchanger by a first fluid connection, the first fluid connection including a first outlet check valve configured to allow flow from the expander to the first heat exchanger and obstruct flow from the first heat exchanger to the expander, and a second outlet check valve configured to allow flow from the expander to the second heat exchanger and obstruct flow from the second heat exchanger to the expander.

10. The heat pump system of claim 9, wherein the receiver assembly is connected to the first heat exchanger and the second heat exchanger by a second fluid connection, the second fluid connection including a first inlet check valve configured to allow flow from the first heat exchanger to the first receiver volume and obstruct flow from the first receiver volume to the first heat exchanger, and a second inlet check valve configured to allow flow from the second heat exchanger to the first receiver volume and obstruct flow from the first receiver volume to the second heat exchanger.

11. The heat pump system of claim 8, further comprising a controller configured to control the controllable valve.

12. The heat pump system of claim 11, wherein the controller is configured to control the controllable valve based on a condensing pressure of the heat pump system.

13. The heat pump system of claim 11, wherein the controller is configured to control the controllable valve based on a discharge temperature of the heat pump system.

14. The heat pump system of claim 11, wherein the controller is configured to control the controllable valve based on an in-volute pressure differential of the compressor.

15. The heat pump system of claim 11, wherein the controller is configured to control the controllable valve so as to allow flow from the second receiver volume to the first receiver volume when fluid is provided by way of the hot gas injection line.

16. A method for operating a heat pump system, comprising:

operating the heat pump system in a cooling mode having a first working fluid charge level, wherein when the heat pump system is in the cooling mode, working fluid flows through a first receiver volume and a second receiver volume in a first flow direction;

operating the heat pump system system in a heating mode having a second working fluid charge level, wherein when the heat pump is in the heating mode, storing an amount of the working fluid that is the difference between the first working fluid charge level and the second working fluid charge level in the first receiver volume, and the working fluid flows through the first receiver volume and the second receiver volume in a second flow direction opposite to the first flow direction; and controlling a variable quantity of refrigerant stored in the second receiver volume based on one or more operational parameters of the heat pump system;

wherein the first receiver volume and the second receiver volume are connected by a fluid line including a controllable valve.

17. The method of claim 16, wherein the one or more operational parameters include at least one of:

a condensing pressure of the heat pump system;

a discharge temperature of the heat pump system; or an in-volute pressure differential of a compressor of the heat pump system.

18. The method of claim 16, further comprising providing an injection of gas from a compressor of the heat pump system to the second receiver volume.

19. The method of claim 16, wherein the difference between the first working fluid charge level and the second working fluid charge level is determined for an ambient temperature of 7° C.

* * * * *